US006968573B2

(12) United States Patent
Silver

(10) Patent No.: US 6,968,573 B2
(45) Date of Patent: Nov. 29, 2005

(54) CONVERTIBLE VENTILATED TROUSERS

(76) Inventor: James Silver, 701 York Road, Dundas, Ontario (CA) L9H 5W9

( * ) Notice: Subject to any disclaimer, the term of this patent is extended or adjusted under 35 U.S.C. 154(b) by 0 days.

(21) Appl. No.: 10/231,069

(22) Filed: Aug. 30, 2002

(65) Prior Publication Data

US 2004/0040068 A1 Mar. 4, 2004

(51) Int. Cl.[7] ..... A41D 1/06
(52) U.S. Cl. ..... 2/227; 2/79; 2/DIG. 1
(58) Field of Search ..... 2/227, 228, 231, 2/233, 213, 124, 126, 269, 71, 72, 242, 267, 2/22, 23, 24, 69, 215, 456, DIG. 1

(56) References Cited

U.S. PATENT DOCUMENTS 308,221 A * 11/1884 Weishampel et al. ..... 4/404
3,761,962 A * 10/1973 Myers ..... 2/79
4,215,435 A * 8/1980 Miele ..... 2/227
4,395,781 A * 8/1983 Myers ..... 2/4
4,449,254 A * 5/1984 Fogg ..... 2/407
4,625,336 A * 12/1986 Derderian ..... 2/79
4,716,594 A * 1/1988 Shannon ..... 2/4
4,722,099 A * 2/1988 Kratz ..... 2/79
4,766,613 A * 8/1988 Wells ..... 2/227
4,811,727 A * 3/1989 Etienne ..... 602/23
5,105,473 A * 4/1992 Valtakari ..... 2/461
5,134,726 A * 8/1992 Ross ..... 2/465
5,153,944 A * 10/1992 Teel ..... 2/243.1
5,173,967 A * 12/1992 Carter ..... 2/242
5,182,812 A * 2/1993 Goldsby ..... 2/79
5,214,797 A * 6/1993 Tisdale ..... 2/455
5,729,832 A * 3/1998 Grilliot et al. ..... 2/23
5,732,412 A * 3/1998 Holden ..... 2/23
5,774,892 A * 7/1998 Tisdale et al. ..... 2/69
5,864,888 A * 2/1999 Archer ..... 2/227
5,901,373 A * 5/1999 Dicker ..... 2/69
5,926,851 A * 7/1999 Kovalik ..... 2/227
5,970,525 A * 10/1999 Gallinot et al. ..... 2/242
6,041,447 A * 3/2000 Endler ..... 2/455
6,085,353 A * 7/2000 van der Sleesen ..... 2/69
6,158,056 A * 12/2000 Riley ..... 2/269
6,189,155 B1 * 2/2001 Boulanger ..... 2/409
6,205,593 B1 * 3/2001 Schaub, Jr. ..... 2/242
6,243,879 B1 * 6/2001 Lyden ..... 2/227
6,339,845 B1 * 1/2002 Burns et al. ..... 2/243.1
6,347,403 B1 * 2/2002 Wilcox ..... 2/23
6,401,250 B1 * 6/2002 McNabb ..... 2/78.2
6,408,446 B1 * 6/2002 Carrington ..... 2/465
6,421,839 B1 * 7/2002 Vo et al. ..... 2/227
6,499,141 B1 * 12/2002 Egnew ..... 2/69

* cited by examiner

*Primary Examiner*—Alissa L. Hoey
(74) *Attorney, Agent, or Firm*—Patrick J. Hofbauer; Kevin E. Holbeche

(57) ABSTRACT

An article of safety clothing is disclosed, and comprises a pair of trousers, of the type including a trunks part adapted to securely receive the lower region of the torso of a wearer in use and having apertures through which the legs of said wearer protrude in use; and a pair of tubular pant leg parts, each adapted to receive therethrough a respective protruding leg of said wearer in use and extending between an upper end, connected to said trunks part, and a lower end. The trunks part is substantially opaque, to conceal the pelvic region of said wearer in use, and each pant leg part includes a vent portion constructed from mesh.

5 Claims, 3 Drawing Sheets

CONVERTIBLE VENTILATED TROUSERS

FIELD OF THE INVENTION

The present invention relates to the field of safety clothing, and more particularly, to safety clothing for use in industrial settings and in athletics pursuits, such as rollerblading.

BACKGROUND OF THE INVENTION

In hot weather, persons often wish to wear shorts, also known as knee breeches, for comfort. However, knee breeches do not constitute suitable apparel, for example, in circumstances wherein, inter alia, the knees of such persons are apt to come into contact with rough surfaces, such as whilst rollerblading. Indeed, in many industrial settings, applicable legislation prohibits knee breeches. Moreover, in some environments, temperatures can plummet significantly in a relatively short period, in which case, persons wearing shorts may become uncomfortably cool.

The prior art is replete with examples of long pants including legs which can be removed from the knee down, thereby to convert into knee breeches, or the reverse. U.S. Pat. No. 269,479 (Stretch et al.), issued Dec. 19, 1882, is exemplary in this regard.

Such clothing articles, of course, ameliorate to some extent the problems caused by fluctuating temperatures, in that, in the event that temperatures cool, the leg portions can be reinstated, but continue to suffer, in that, when in their knee breech configuration, they expose the lower part of the wearers' legs to injury by, inter alia, abrasion.

It is an object of the present invention to provide an article of safety clothing which is relatively comfortable to wear in warm conditions, while at the same time, maintaining protective qualities comparable to those inherent in trousers.

SUMMARY OF THE INVENTION

In accordance with the present invention there is disclosed an article of safety clothing.

As one aspect of the invention, the article of safety clothing comprises a pair of trousers. The trousers of the type which includes a trunks part, adapted to securely receive in encompassing relation the lower region of the torso of a wearer in use and having apertures through which the legs of said wearer protrude in use, and a pair of tubular leg parts, each adapted to receive therethrough a respective protruding leg of said wearer in use and extending between an upper end, connected to said trunks part, and a lower end. The trunks part is substantially opaque, to conceal the pelvic region of said wearer in use, and each pant leg part includes a vent portion constructed from mesh.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

In the accompanying drawings, which should be expressly understood to be for the purpose of illustration and description only, and are not intended as a definition of the limits of the invention.

DETAILED DESCRIPTION OF A PREFERRED EMBODIMENT

Figure 1:
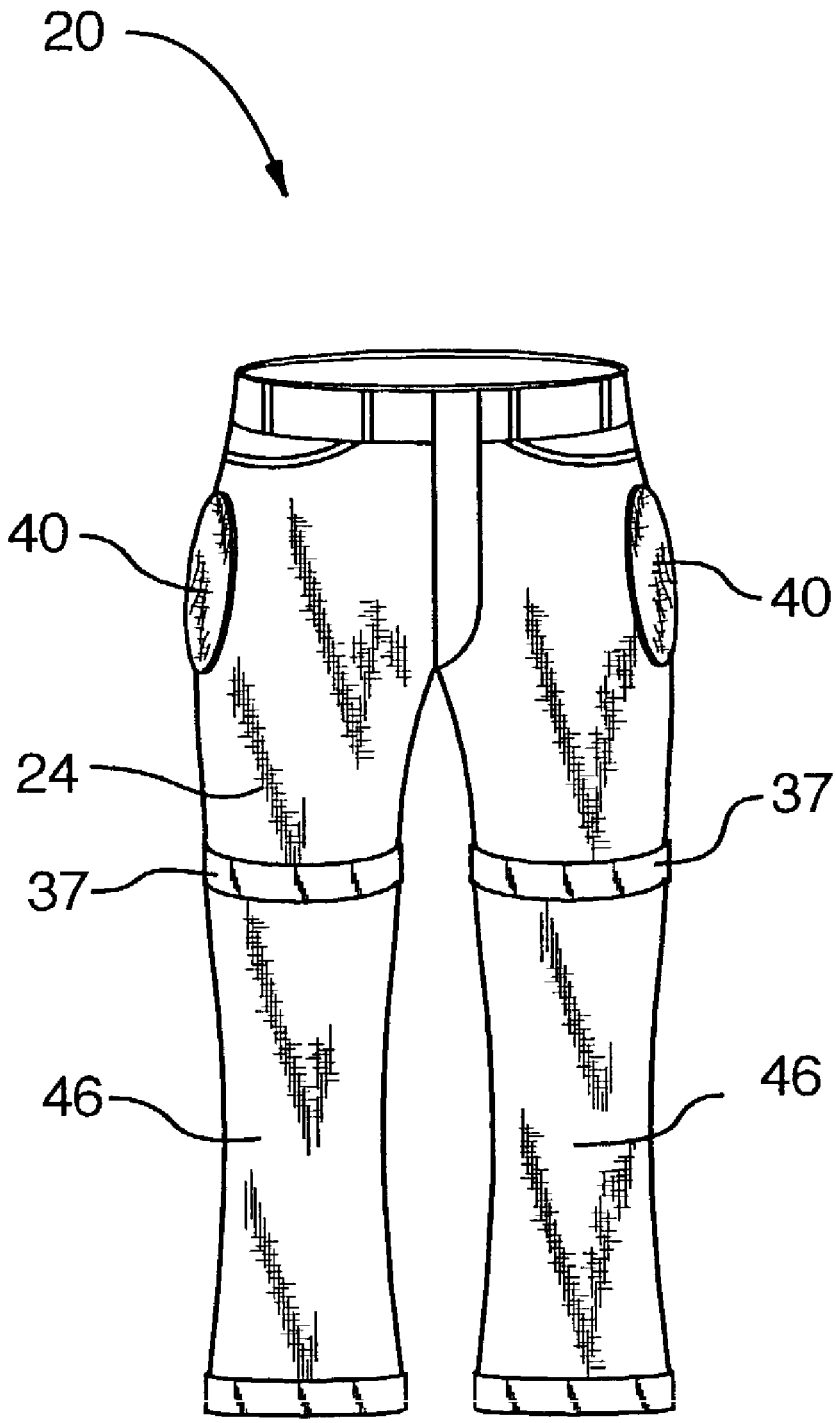
FIG. 1 is a front elevational view of an article of safety clothing according to a preferred embodiment of the present invention.

Referring now to FIG. 1 of the drawings there is shown an article of safety clothing according to a preferred embodiment of the present invention, designated with general reference numeral 20.

Figure 3:
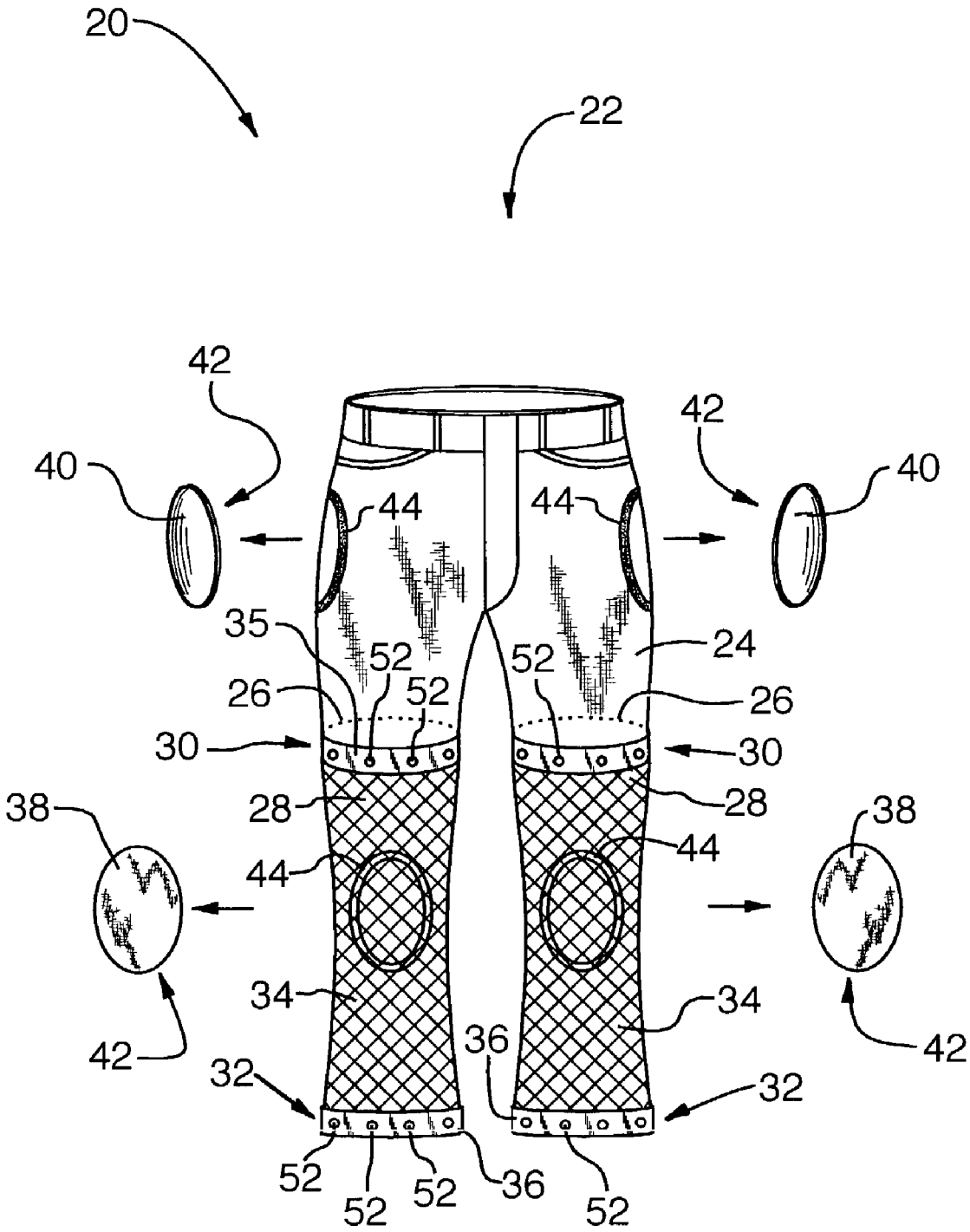
FIG. 3 is an exploded view of the unexploded portion of the article shown in FIG. 2.

As best indicated in FIG. 3, the article 20 comprises a pair of trousers 22 of the type including a trunks part 24 adapted to securely receive in encompassing relation the lower region of the torso of a wearer in use and having apertures, defined in dotted outline in FIG. 3 and designated with general reference numerals 26, through which the legs of said wearer protrude in use, and a pair of tubular pant leg parts 28 each adapted to receive a respective protruding leg of said wearer in use and extending between an upper end 30 which is connected, by stitching or the like, to said trunks part 24, and a lower end 32.

The trunks part 24 of the preferred embodiment illustrated is substantially opaque, so as to conceal the pelvic region of said wearer in use, and is constructed of relatively sturdy, breathable and washable material, such as, for example a cotton-polyester woven textile of substantially closed texture.

Each pant leg part 28 includes a vent portion 34 constructed from a relatively sturdy, washable mesh material of substantially open texture, for example, a polyester mesh, such as is used in some athletic jerseys.

It will be evident that even a relatively small vent portion 34 will enhance overall air flow, and thus, enhance comfort to the wearer in hot temperatures. However, as will be evident, in the preferred embodiment, wherein the leg parts 28 each extend, in use, between about the knee to about the ankle of the respective leg received within said each pant leg part 28, the pant leg parts 28 are constructed substantially from mesh, to maximize air flow and comfort, with only a reinforced cuff 36 being sewn onto the mesh at the lower end 32 of the leg part 28. The provision of such reinforced cuff 36 avoids undue wear, which might otherwise occur if the mesh extended fully through to the lower end 32.

Figure 2:
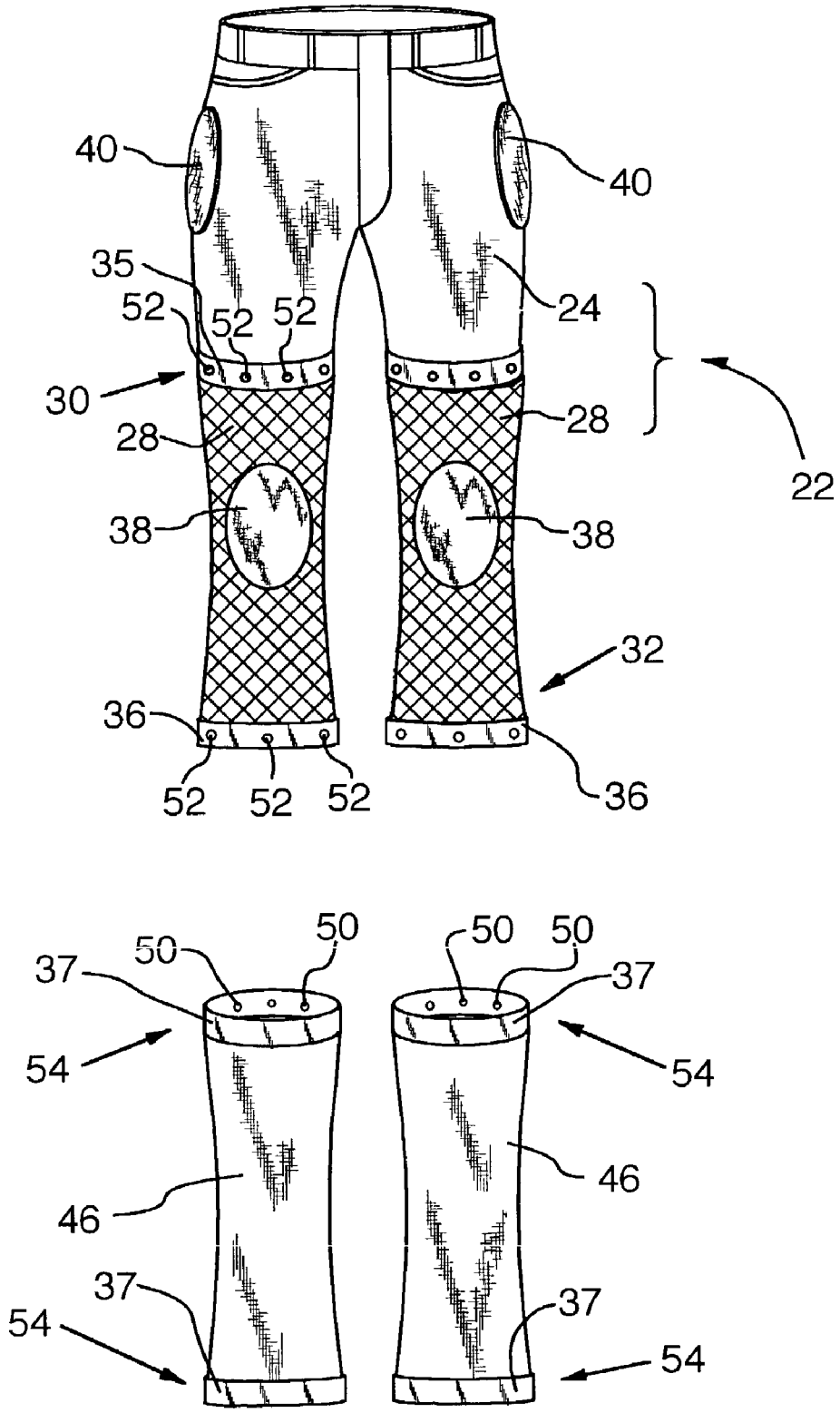
FIG. 2 is a partially exploded view of the article of safety clothing of FIG. 1.

As other features of the preferred embodiment, best seen in FIG. 2, a pair of first pads 38 are removably attached to said trousers 22 to cover respective knees of said wearer in use, and a pair of second pads 40 are removably attached to said trousers 22 to cover respective hips of said wearer in use. As best indicated in FIG. 3, such removable attachment is effected, in the preferred embodiment, by hook 42 and loop 44 fasteners, of the type sold by Velcro Inc. under the trade-mark VELCRO, secured to the pads 38,40 and the trousers 22, respectively. The first pads 38 and the second pads 40 are shown attached to the trousers 22 in FIG. 2, and detached therefrom in FIG. 3.

As a further feature, best illustrated in FIG. 1, a pair of tubular leg shells 46 are preferably provided, and detachably secured to said trunks part 24 for covering said pant leg parts 28 and, when attached, said first pads 38. Shells 46 are constructed of relatively durable, weatherproof, washable and fire-resistant material of substantially closed texture, so as to maximize protection from, inter alia, the elements and workplace hazards, when attached. Such detachable securement of the shells 46 is effected, in the preferred embodiment illustrated, by a plurality of conventional snaps each comprising a male snap 50 and a female snap 52; the female snaps 52, as illustrated in FIG. 3, are fixedly secured to band portions 35 which extend about the apertures 26 in the trunks part 24, and about the reinforced cuffs 36 of the trousers 22, and the male snaps 50, as indicated in FIG. 2, are fixedly secured about the inner periphery of tubular fillet portions 37 disposed at opposite ends 54 of the shells 46.

In use, the article of safety clothing 20 can be worn in the manner of conventional trousers. In for example, cold weather, the shells 46 may be slipped over the leg parts 28, and secured to the trunks part 24 by snaps 50,52; in hot weather, the process may be reversed, and the shells 46 rolled up and conveniently stored, in, for example, a lunch box. Depending upon the type of activity in which the wearer is to be engaged, the first pads 38 and the second pads 40 may be secured to the trousers 22, or removed from the trousers 22 and stored.

In the preferred embodiment illustrated, the reinforced cuffs 36, fillet portions 37 and band portions 35 are constructed of a reflective fabric, so as to render the wearer more visible to motorized vehicles in darkness.

Various modifications may be used in the design and manufacture of the according to the present invention without departing from the spirit and scope of the invention.

For example, whereas the preferred trunk part illustrated takes the form of knee breeches, that is, pants having legs extending roughly to the knees, it will be evident that the trunks part could, for example, be configured with relatively shorter legs, or even with no legs at all, in the form of a Bikini.

As well, whereas the preferred trunks part is substantially opaque throughout, it will be appreciated that this strictly need not be the case.

Further, whereas the first pads and the second pads of the preferred embodiment are removably attached, by hook and loop fasteners, it will be evident that other means for such removable attachment, such as, for example, zippers, could be utilized. Moreover, the first pads and the second pads could be rigidly affixed, by stitching, or omitted altogether.

Yet further, whereas the shells of the preferred embodiment are secured by snaps, it will be evident that securement could be effected through other conventional means, such as zippers, buttons or hook and loop fasteners.

As well, whereas in the preferred embodiment illustrated, the reinforced cuffs, fillet portions and band portions are constructed of a reflective fabric, it should be understood that, alternatively, reflective material could be secured to the trousers, for example, in a vertical line along each outer seam.

Moreover, while reinforced cuffs are provided in the preferred embodiment, it should be understood that cuffs are not essential. For example, the ends of the pant leg parts could be provided with drawstring closures, elastic banding or a flap-type closure, with hook and loop fasteners, in circumstances wherein it was desired to ensure a snug fit around, for example, the safety boots of a wearer. Stirrups could also be provided, so as to ensure that the pant leg parts did not inadvertently ride up on the legs of the wearer, and expose same to possible injury.

Accordingly, it should be understood that the present invention is limited only by the accompanying claims, purposively construed.

I claim:

1. An article of safety clothing comprising a pair of trousers, of the type including:

a trunks part, adapted to securely receive in encompassing relation the lower region of the torso of a wearer in use and having apertures through which the legs of said wearer protrude in use; and a pair of tubular pant leg parts, each adapted to receive therethrough a respective protruding leg of said wearer in use and extending between an upper end, connected to said trunks part, and a lower end; and a pair of tubular legs shells detachably secured by securement means affixed to said trunks part for covering said pant leg parts, wherein the trunks part is substantially opaque, to conceal the pelvic region of said wearer in use; and the pant leg parts are constructed substantially from athletic mesh of substantially open texture and each extend from about the knee to about the ankle of the respective leg received within said each pant leg part.

2. An article according to claim 1, further comprising a pair of first pads attached to said trousers to cover respective knees of said wearer in use.

3. An article according to claim 1, further comprising a pair of first pads removably attached to said trousers to cover respective knees of said wearer in use.

4. An article according to claim 1, further comprising a pair of second pads attached to said trousers to cover respective hips of said wearer in use.

5. An article according to claim 1, further comprising a pair of second pads removably attached to said trousers to cover respective hips of said wearer in use.

* * * * *